United States Patent [19]

Fujita et al.

[11] Patent Number: 4,824,721

[45] Date of Patent: Apr. 25, 1989

[54] DONOR SHEET FOR HEAT TRANSFER RECORDING

[75] Inventors: Yutaka Fujita; Sumitaka Tatsuta, both of Shizuoka, Japan

[73] Assignee: Fuji Photo Film Co., Ltd., Kanagawa, Japan

[21] Appl. No.: 78,957

[22] Filed: Jul. 29, 1987

[30] Foreign Application Priority Data

Jul. 29, 1986 [JP] Japan ..... 61-178446

[51] Int. Cl.[4] ..... B41M 5/26

[52] U.S. Cl. ..... 428/321.5; 428/195; 428/323; 428/336; 428/402.2; 428/402.22; 428/480; 428/913; 428/914

[58] Field of Search ..... 427/150–152; 428/321.5, 195, 323, 336, 402.2, 402–422, 480, 913, 914; 503/208, 209, 215; 8/471

[56] References Cited

FOREIGN PATENT DOCUMENTS 2158958A 11/1985 United Kingdom ..... 503/215

*Primary Examiner*—Bruce H. Hess

*Attorney, Agent, or Firm*—Sughrue, Mion, Zinn, Macpeak & Seas

[57] ABSTRACT

A heat transfer recording medium composed of a support having provided thereon (a) microcapsules containing an oil-soluble dye dissolved in an organic solvent and (b) a sensitizer that is solid at ordinary temperature and capable of melting on heating to swell the microcapsule wall and release the dye. This heat transfer recording medium can be used as a sheet in, for example, a facsimile and a printer, for excellent gradation in printed images, and reduced fogging.

12 Claims, No Drawings

DONOR SHEET FOR HEAT TRANSFER RECORDING

FIELD OF THE INVENTION

The present invention relates to a donor sheet for heat transfer recording, which is used in office machines such as a facsimile and a printer, and more particularly, to a donor sheet for heat transfer recording which permits gradation recording and thus is suitable for full color recording.

BACKGROUND OF THE INVENTION

In the field of non-impact printing, heat transfer recording is rapidly increasing, particularly using various terminal printers. In recent years, color hard copy has been increasingly needed, and a sublimation type heat transfer printer has been developed as a video printer.

Heat transfer recording can be generally divided into two types: melt type heat transfer recording and sublimation type heat transfer recording. The sheet for use in melt type heat transfer recording has a basic structure in which a colorant is compounded in waxes capable of melting on heating and coated on a support in a thickness of about 5 μm. This sheet has the advantages that sensitivity is high and storage stability is good, but the disadvantages that gradation cannot be obtained unless specified techniques are employed, recording cannot be conducted repeatedly, and transferability to a rough surface is inferior. The sheet for use in sublimation type heat transfer recording has a basic structure in which a transfer layer composed mainly of sublimation dye and a binder is coated on a heat-resistant support. This sheet has the advantage that gradation can be easily obtained. However, the sheet has the serious disadvantages that a large amount of energy is needed for obtaining the necessary recording density and special dye-receiving paper is needed, so that ordinary paper cannot be used. Another disadvantage of this sheet is that the color of the formed image disappears with the lapse of time.

Utilization of microcapsules in a heat transfer sheet is known. For example, microcapsules containing a colorant are described in, for example, U.S. Pat. No. 4,564,534, Japanese patent application (OPI) Nos. 207286/83, 211498/83, and 85992/85 (the term "OPI" as used herein means an "unexamined published Japanese patent application"). Microcapsules containing a colorant and a foaming agent are described in, for example, U.S. Pat. No. 4,564,534, Japanese patent application (OPI) Nos. 59897/83 and 224790/83. In these microcapsules, the microcapsule walls are broken by application of pressure utilizing a platen, or gas pressure produced by the foaming agent, or heat pressure, and the colorant contained in the microcapsules is released.

In these microcapsules, therefore, it is necessary to increase the amount of enegy applied or the pressure applied.

Another technique is to control the glass transition temperature of the microcapsule wall to the range of 0° to 120° C. (as described in Japanese patent application (OPI) Nos. 189490/85 and 189491/85). In this case, the microcapsule is partially broken by application of heat. It is expected, in this case, that the amount of energy required can be decreased as compared with the above method. At the same time, however, a problem arises with the storage stability of the microcapsules.

In order to utilize the permeability of the microcapsules, U.S. Pat. No. 4,579,770 discloses microcapsules incorporating a sublimating dye, and Japanese patent application (OPI) No. 196294/84 discloses microcapsules having the walls of Nylon and a synthetic bimolecular membrane. In the former, dye vapor resulting from sublimation of the dye permeates through the microcapsule wall, and thus a larger amount of energy is needed than in the general sublimation type heat transfer. In the latter, only a water-soluble colorant can be incorporated in the microcapsule owing to the structure of the bimolecular membrane, and the transfer image formed is poor in water resistance.

As described above, conventional melt type and sublimation type heat transfer recording techniques have advantages and disadvantages. That is, in the melt type heat transfer recording, gradation is difficult to obtain and also the transfer of an image to rough surfaces is difficult, and in the sublimation type heat transfer recording, energy sensitivity is low, transfer to ordinary paper cannot be attained, and the storage stability of images is poor.

SUMMARY OF THE INVENTION

An object of the present invention is to provide a heat transfer sheet which is free from the defects of the conventional techniques, is of high sensitivity, is of good gradation, and which permits image transfer to ordinary paper.

Another object of the present invention is to provide a heat transfer sheet which is excellent in storage stability.

As a result of intense investigation, now it has been found that these and other objects of the invention can be attained by providing a donor sheet for heat transfer recording which is composed of a support having thereon (a) microcapsules containing an oil-soluble dye dissolved in an organic solvent and (b) a sensitizer being solid at ordinary temperature and capable of melting on heating to swell the microcapsule walls and release said dye.

DETAILED DESCRIPTION OF THE INVENTION

The microcapsules of the present invention contain a liquid having dissolved therein an oil-soluble dye, and their walls are made of a dense polymer not substantially releasing the incorporated liquid at ordinary temperature. In the invention a solid sensitizer melts on heating and permeates through the microcapsule wall, thereby swelling the microcapsule wall and releasing the contents. The solid sensitizer according to the present invention may be present inside or outside the microcapsules.

Accordingly, during storage, the core substance is not released from the microcapsule. At the time of printing, transfer can be attained by application of a small amount of energy. Futhermore, since the present invention utilizes the phenomenon of penetration and diffusion of the dye, transfer coloration does not occur abruptly accordingly to a change in temperature, but proceeds gradually. Thus, images having gradation can be realized.

The present invention is directed to a technique in which recording is achieved by utilizing the diffusion and penetration of dye through the microcapsule walls. In general, the coefficient of diffusion of a substance through a thin polymeric membrane increases only slowly with a rise in temperature. For this reason, microcapsules having polymer walls which allow a sufficiently large amount of dye to pass through the walls upon application of heat in a short time, e.g., by a thermal head, are unsuitable for practical use because when stored at an ordinary temperature, they allow the dye to gradually pass therethrough. On the other hand, in the case of dense microcapsule walls not permitting the penetration of dye at an ordinary temperature, almost no dye passes through the walls when heat printing takes place in a short time using a thermal head, and thus recording cannot be attained.

It has been found according to the present invention that if a solid sensitizer capable of swelling the microcapsule walls is used, the permeability of the capsule walls can be greatly increased.

As dyes which are used in the present invention, various oil-soluble dyes commonly used in conventional recording materials can be used. Examples of these oilsoluble dyes include copper phthalocyanine dyes, xanthene dyes, azo dyes and triphenyl dyes. Specific examples thereof include Aizen Spilon Blue 2BNH, Aizen Spilon Red GRLH, Aizen Spilon Yellow GRLH, Aizen Spilon Black MH (all produced by Hodogaya Chemical Co., Ltd.), Kayaset Blue KFL, Kayaset Red K-BL, Kayaset Yellow K-CL, Kayaset Black K-RL (all prodused by Nippon Kayaku Co., Ltd.), Oil Cyanin 1, Oil Magenta 1, Oil Yellow 1 (all produced by Sumitomo Chemical Co., Ltd.) and, as oil-soluble base dyes, Victoria Blue-B Base, Methyl Violet Base, Rhodamine B Base, and Yellow AU Base (all produced by Hodogaya Chemical Co., Ltd.). However, the present invention is not limited to the above compounds.

As organic solvents to dissolve the above dyes, phosphoric acid esters, phthalic acid esters, other carboxylic acid esters, carbonic acid esters, fatty acid amides, alkylated biphenyls, alkylated terphenyls, chlorinated paraffins, alkylated naphthalenes, diarylethane can be used. Specific examples thereof include tricresyl phosphate, trioctyl phosphate, octyldiphenyl phosphate, tricyclohexyl phosphate, dibutyl phthalate, dioctyl phthalate, dilauryl phthalate, dicyclohexyl phthalate, butyl oleate, diethylene glycol dibenzoate, dioctyl sebacate, dibutyl sebacate, dioctyl adipate, trioctyl trimellitate, acetyltriethyl citrate, octyl maleate, dibutyl maleate, propylene carbonate, diphenylcarbonic acid, isopropylbiphenyl, isoamylbiphenyl, chlorinated paraffin, diisopropylnaphthalene, 1,1'-ditolylethane, 2,4-di-tert-aminophenol, and N,N-dibutyl-2-butoxy-5-tert-octylaniline. However, the present invention is not limited to the above compounds. Among these solvents, phosphoric acid esters, particularly, phosphoric acid esters having at least 20 carbon atoms are preferably used.

When the above-described oil-soluble base dyes are used, higher fatty acids such as oleic acid, stearic acid, linolic acid and linoleic acid can be used alone or in combination with the above-described organic solvents. The dyes according to the present invention are used preferably in an amount of from 5 to 50 wt % based on the weight of the organic solvent.

As solid sensitizers which are used in the present invention to swell the microcapsule walls at the time of heating, compounds having a melting point of about 50 to 200° C. are preferred. Of compounds which are plasticizers for the microcapsule wall polymer, those having a melting point of at least about 50° C. and solid at an ordinary temperature are suitably used. These polymer-plasticizer combinations are chosen appropriately from those described e.g., in *Modern Plastics Encyclopedia,* Vol. 42, No. 1A, pp. 358–380, McGraw-Hill (1965). For example, when the capsule wall is made of polyurea or polyurethane, suitable solid sensitizers include hydroxy compounds, carbamic acid ester compounds, aromatic alkoxy compounds, organic sulfonamide compounds, aliphatic amide compounds and arylamide compounds.

Specific examples of hydroxy compounds include phenols such as p-tert-butylphenol, p-tert-octylphenol, p-α-cumylphenol, p-tert-pentylphenol, m-xylenol, 2,5-dimethylphenol, 2,4,5-trimethylphenol, 3-methyl-4-isopropylphenol, p-benzylphenol, o-cyclohexylphenol, p-(diphenylmethyl)phenol, p-(α,α-diphenylethyl)-phenol, o-phenylphenol, ethyl p-hydroxybenzoate, chloropyl p-hydroxybenzoate, butyl p-hydroxybenzoate, benzyl p-hydroxybenzoate, p-methoxyphenol, p-butoxyphenol, p-heptyloxyphenol, p-benzyloxyphenol, dimethylvaniline 3-hydroxyphthalate, 1,1-bis(4-hydroxyphenol)dodecane, 1,1-bis(4-hydroxyphenyl)-2-ethylhexane, 1,1-bis(4-hydroxyphenyl)-2-methylpentane, 2,2-bis(4-hydroxyphenyl)heptanevaniline, 2-tert-butyl-4-methoxyphenol, 2,6-dimethoxyphenol, and 2,2'-dihydroxy-4-methoxybenzophenone; and alcohol compounds such as 2,5-dimethyl-2,5-hexanediol, resorcinol di(2-hydroxy)ether, resorcinol mono(2-hydroxyethyl)ether, salicyl alcohol, 1,4-di(hydroxyethoxy)benzene, p-xylilinediol, 1-phenyl-1,2-ethanediol, diphenylmethanol, 1,1-diphenylethanol, 2-methyl-2-phenyl-1,3-propanediol, 2,6-dihydroxy-methyl-p-cresol benzyl ether, 2,6-dihydroxymethyl-p-cresol benzyl ether, and 3-(o-methoxyphenoxy)-1,2-propanediol.

Specific examples of carbamic acid esters include ethyl N-phenylcarbamate, benzyl N-phenylcarbamate, phenetyl N-phenylcarbamate, benzyl carbamate, butyl carbamate and isopropyl carbamate.

Specific examples of aromatic alkoxy compounds include 2-methoxybenzoic acid, 3,5-dimethoxyphenylacetic acid, 2-methoxynaphthalene, 1,3,5-trimethoxybenzene, p-dimethoxybenzene and p-benzyloxymethoxybenzene.

Specific examples of organic sulfonamides include p-toluenesulfonamide, o-toluenesulfonamide, benzenesulfonamide, p-toluenesulfonanilide, N-(p-methoxyphenyl)-p-toluenesulfonamide, N-(o-methoxyphenyl)-p-toluenesulfonamide, N'-(p-chlorophenyl)-p-toluenesulfonamide, N-(o-chlorophenyl)-p-toluenesulfonamide, N-(p-tolyl)-p-toluenesulfonamide, N-(o-tolyl)-p-toluenesulfonamide, N-(o-hydroxyphenyl)-p-toluenesulfonamide, N-benzyl-p-toluenesulfonamide, N-(2-phenetyl)-p-toluenesulfonamide, N-(2-hydroxyethyl)-p-toluenesulfonamide, N-(3-methoxypropyl)-toluenesulfonamide, methanesulfonanilide, N-(p-tolyl)-sulfonamide, N-(o-tolyl)sulfonamide, N-(p-methoxyphenyl)-sulfonamide, N-(o-methoxy)sulfonamide, N-(p-chlorophenyl)-sulfonamide, N-(o-chlorophenyl)sulfonamide, N-(2,4-xylyl)-sulfonamide, N-(p-ethoxyphenyl)sulfonamide, N-benzylmethanesulfonamide, N-(2-phenoxyethyl)methanesulfonamide, 1,3-bis(methanesulfonylamino)benzene and 1,3-bis(p-toluenesulfonylamino)propane.

Specific examples of aliphatic amide compounds include phenylacetoamide, phenoxyacetoamide, oleic acid amide, propionic acid amide and malonamide.

Specific examples of arylamide compounds include benzamide, methylbenzamide, ethylbenzamide, methoxybenzamide, ethoxybenzamide, chlorobenzamide and dichlorobenzamide.

However, the present invention is not limited to the above compounds. Among these solid sensitizers, p-benzyloxyphenol and p-toluenesulfonamide are preferably used.

The layer in which the above solid sensitizer is to be incorporated may be the same as or different from that in which the microcapsules are present. In more detail, it is preferred that the solid sensitizer be dispersed as a solid in combination with a water-soluble polymer by the use of e.g., a Dyno mill. Preferred water-soluble polymers are the water-soluble polymers used to prepare microcapsules as described hereinafter in detail. The concentration of the water-soluble polymer solution is about 2 to 30 wt %. The amount of the solid sensitizer used is about 5 to 40 wt % of the water-soluble polymer solution. The particle size of the solid sensitizer dispersed is preferably not more than about 10 μm. Specifically, the particle size preferably ranges from 0.1 to 5 μm, more preferably, from 0.5 to 2 μm. The amount of the solid sensitizer used is desirably about 0.05 to 1 part by weight per part by weight of the capsules.

The microcapsule of the present invention is prepared by emulsifying (oil-in-water emulsion) a core substance containing a dye and then forming the walls of a polymeric substance on the surface of oil droplets. Reactants forming the polymeric substance are added to the inside and/or the outside of oil droplets.

Specific examples of polymeric substances include polyurethane, polyurea, polyamide, polyester, polycarbonate, a urea-formaldehyde resin, a melamine resin, polystyrene, a styrene-methacrylate copolymer, a styreneacrylate copolymer, gelatin, polyvinylpyrrolidone and polyvinyl alcohol.

These polymeric substances can be used alone or in combinations of two or more. Preferred polymeric substances include polyurethane, polyurea, polyamide, polyester and polycarbonate. More preferred are polyurethane and polyurea.

For preparation of the microcapsule walls of the present invention, a microencapsulation method utilizing the polymerization of reactants from the inside of oil droplets is effective to produce capsules which have a uniform particle size, and a recording material excellent in storage stability before recording.

The above microencapsulation method and examples of compounds are described in U.S. Pat. Nos. 3,726,804 and 3,796,669.

For example, when polyurea is used as a material for the preparation of capsule walls, a polyvalent isocyanate is mixed with an oily liquid to be encapsulated, emulsified and dispersed in water or an aqueous polyamine solution, and raised in temperature, whereupon a polymer-forming reaction occurs on the surface of oil droplets and the microcapsule walls are formed. An auxiliary solvent which has a low boiling point and a high dissolving power can advantageously be present in the oily liquid.

Polyisocyanates and polyamines which are used in this method are described in U.S. Pat. Nos. 3,281,383, 3,773,695, 3,793,268 and 3,838,108, British Patent Nos. 1,127,338 and 1,416,224, and Japanese Patent Publication No. 24159/84.

When a polyol is reacted with an isocyanate, polyurethane walls are formed.

Examples of isocyanates which can be used include diisocyanates such as m-phenylenediisocyanate, p-phenylenediisocyanate, 2,6-tolylenediisocyanate, 2,4-tolylenediisocyanate, naphthalene-1,4-diisocyanate, diphenylmethane-4,4'-diisocyanate, 3,3'-dimethoxy-4,4'-biphenyldiisocyanate, 3,3'-dimethyldiphenylmethane-4,4'-diisocyanate, xylilene-1,4-diisocyanate, 4,4'-diphenylpropanediisocyanate, trimethylenediisocyanate, hexamethylenediisocyanate, propylene-1,2-diisocyanate, butylene-1,2-diisocyanate, cyclohexylene-1,2-diisocyanate, and cyclohexylene1,4-diisocyanate; triisocyanates such as 4,4',4''-triphenylmethane-triisocyanate, and toluene-2,4,6-triisocyanate; tetraisocyanates such as 4,4'-dimethyldiphenylmethane2,2',5,5'-tetraisocyanate; and isocyanate prepolymers such as a hexamethylenediisocyanate-trimethylolpropane adduct, a 2,4-tolylenediisocyanate-trimethylolpropane adduct, a xylilenediisocyanate-trimethylolpropane adduct, and a tolylenediisocyanate-hexanetriol adduct.

In preparation of the microcapsules, water-soluble polymers can be used, including any of water-soluble anionic polymers, nonionic polymers and amphoteric polymers. As anionic polymers, any of synthetic and natural polymers can be used, including polymers having groups such as $-COO^-$ and $-SO_3^-$. Specific examples of anionic natural polymers are gum arabic and alginic acid. Semisynthetic polymers include carboxymethyl cellulose, phthalated gelatin, sulfated starch, sulfated cellulose and ligninsulfonic acid.

Synthetic polymers include maleic anhydride-based copolymers (including those hydrolyzed), acrylic acid-based polymers and copolymers (including methacrylic acid-based polymers and copolymers), vinylbenzenesulfonic acid-based polymers and copolymers, and carboxy-modified polyvinyl alcohol.

Nonionic polymers include polyvinyl alcohol, hydroxyethyl cellulose and methyl cellulose.

An example of an amphoteric polymer is gelatin.

These water-soluble polymers are used as an aqueous solution containing about 0.01 to 10 wt % of the polymers. The particle size of the microcapsule is adjusted to about 0.1 to 20 μm. The coating amount of microcapsules is preferably from 0.5 to 20 g/m$^2$.

As the support to be used for the heat transfer sheet of the present invention, a polyester film, particularly a polyester film the back surface of which treated, e.g., to impart slippability, heat resistance and antistatic properties. The thickness of the support is preferably about 1 to 10 μm.

Preferably, prior to the coating of a transfer layer containing microcapsules, a solid sensitizer on a support, a subbing layer is provided for the purpose of preventing the transfer layer from being peeled apart at the time of printing. As the subbing layer, an acrylate copolymer, polyvinylidene chloride, styrene-butadiene rubber, water-soluble polyester can be used. The thickness of the layer is preferably about 0.1 to 0.5 μm.

To the transfer layer, if desired, pigment, wax, a hardener may be added. The thickness of the transfer layer is preferably 1 to 10 μm, more preferably, about 0.5 to 10 μm.

The present invention is described in greater detail with reference to the following examples, but the present invention is not to be construed as being lmmited thereto. Unless otherwise indicated, all parts, percents and ratios are by weight.

EXAMPLE 1

3 parts of Victoria Blue-B Base (produced by Hodogaya Chemical Co., Ltd.), 20 parts of oleic acid, 5 parts of methylene chloride and 15 parts of Takenate D110N (an adduct of xylylenediisocyanate with trimethylolpropane; produced by Takeda Chemical Industries, Ltd.) were mixed, added to 55 parts of a 6% aqueous polyvinyl alcohol (molecular weight:50,000) solution, and emulsified to obtain an oil-in-water emulsion having an average oil droplet diameter of 1 μm.

100 ml of water was added to the emulsion and stirred at 40° C. for 3 hours to perform encapsulation. Dye remaining unencapsulated was removed by the use of an ion exchange resin.

15 parts of p-benzyloxyphenol and 33 parts of 4.5% aqueous polyvinyl alcohol solution were dispersed in a Dyno mill to obtain a dispersion (particle size: 1 μm).

As a support, a 3.5 μm thick polyethylene terephthalate film with a heat-resistant and sticking-preventing layer provided on the back surface thereof was used. First a polyvinylidene chloride latex (10%) having a particle size of 0.1 μm was bar coated and dried to form a subbing layer about 0.5 μm thick. Then 12 parts of the above capsule solution and 3 parts of the dispersion were mixed, bar coated and then dried on the subbing layer to form a transfer layer about 3 μm thick.

The heat transfer sheet thus obtained was placed on an ordinary paper such that the transfer surface was in contact with the paper, and printed by applying heat energy from the back of the transfer sheet by the use of a thermal head. The density obtained was measured by Macbeth reflective densitometer. The results are shown in Table 1.

TABLE 1

| Applied Energy (mJ/mm$^2$) | Image Density (OD (Cyan)) |
|---|---|
| 0 | 0.05 |
| 4 | 0.15 |
| 8 | 0.40 |
| 12 | 0.55 |
| 16 | 0.75 |
| 20 | 1.05 |
| 24 | 1.25 |
| 28 | 1.40 |
| 32 | 1.50 |

In this example, the maximum degree of swelling of the microcapsule wall at the time of heating reached 30%. This degree of swelling was determined as follows.

A model film was produced using the same material as used in the preparation of the microcapsule. The film was heated to 150° C. for 2 hours to melt the sensitizer and the model film was impregnated with the molten sensitizer. Then a change in thickness of the film was measured to determine the degree of swelling.

EXAMPLE 2

2 parts of Aizen Spilon Blue 2BNH (produced by Hodogaya Chemical Co., Ltd.), 20 parts of tricresyl phosphate, 5 parts of methylene chloride and 10 parts of Takenate D110N (produced by Takeda Chemical Industry, Ltd.) were mixed, emulsified, encapsulated, and coated to obtain a heat transfer sheet in the same manner as in Example 1.

This heat transfer sheet was evaluated in the same manner as in Example 1. The results are shown in the following Table 2.

TABLE 2

| Applied Energy (mJ/mm$^2$) | Image Density (OD (Cyan)) |
|---|---|
| 0 | 0.03 |
| 4 | 0.05 |
| 8 | 0.17 |
| 12 | 0.31 |
| 16 | 0.63 |
| 20 | 0.91 |
| 24 | 1.05 |
| 28 | 1.15 |
| 32 | 1.2 |

In this case, the degree of swelling of the microcapsule wall upon heating was the same as in Example 1.

EXAMPLE 3

A heat transfer sheet was produced in the same manner as in Example 1 except that Rhodamine B Base (produced by Hodogaya Chemical Co., Ltd.) was used as the dye. The performance of the sheet is shown in Table 3.

TABLE 3

| Applied Energy (mJ/mm$^2$) | Image Density (OD (Cyan)) |
|---|---|
| 0 | 0.05 |
| 4 | 0.16 |
| 8 | 0.34 |
| 12 | 0.59 |
| 16 | 0.88 |
| 20 | 1.20 |
| 24 | 1.30 |
| 28 | 1.35 |
| 32 | 1.40 |

In this case, the degree of swelling of the microcapsule wall upon heating was the same as in Example 1.

EXAMPLE 4

A heat transfer sheet was produced in the same manner as in Example 1 except that Yellow AU Base (produced by Hodogaya Chemical Co., Ltd.) was used as the dye. The performance of the sheet is shown in Table 4.

TABLE 4

| Applied Energy (mJ/mm$^2$) | Image Density (OD (Yellow)) |
|---|---|
| 0 | 0.05 |
| 4 | 0.24 |
| 8 | 0.42 |
| 12 | 0.62 |
| 16 | 0.92 |
| 20 | 1.08 |
| 24 | 1.20 |
| 28 | 1.27 |
| 32 | 1.40 |

In this case, the degree of swelling of the microcapsule upon heating was the same as in Example 1.

EXAMPLE 5

A heat transfer sheet was produced in the same manner as in Example 1 except that p-toluenesulfonamide was used in place of p-benzyloxyphenol. The performance of the sheet is shown in Table 5.

TABLE 5

| Applied Energy (mJ/mm$^2$) | Image Density (OD (Cyan)) |
|---|---|
| 0 | 0.05 |
| 4 | 1.10 |
| 8 | 0.30 |
| 12 | 0.45 |
| 16 | 0.62 |

TABLE 5-continued

| Applied Energy (mJ/mm²) | Image Density (OD (Cyan)) |
|---|---|
| 20 | 0.90 |
| 24 | 1.15 |
| 28 | 1.25 |
| 32 | 1.40 |

In this case, the maximum degree of swelling of the microcapsule wall upon heating was 25%.

EXAMPLE 6

A heat transfer sheet was produced in the same manner as in Example 1 except that benzamide was used in place of p-benzyloxyphenol. The performance of the sheet is shown in Table 6.

TABLE 6

| Applied Energy (mJ/mm²) | Image Density (OD (Cyan)) |
|---|---|
| 0 | 0.08 |
| 4 | 0.18 |
| 8 | 0.42 |
| 12 | 0.58 |
| 16 | 0.80 |
| 20 | 1.10 |
| 24 | 1.35 |
| 28 | 1.50 |
| 32 | 1.55 |

The maximum degree of swelling of the microcapsule wall upon heating was 40%.

COMPARATIVE EXAMPLE 1

A transfer layer was formed using the capsule solution of Example 1 except that p-benzyloxyphenol was omitted, and a heat transfer sheet having the same dye coated amount as in Example 1 was produced. The performance of the sheet is shown in Table 7.

TABLE 7

| Applied Energy (mJ/mm²) | Image Density (OD (Cyan)) |
|---|---|
| 0 | 0.05 |
| 4 | 0.08 |
| 8 | 0.10 |
| 12 | 0.22 |
| 16 | 0.35 |
| 20 | 0.50 |
| 24 | 0.75 |
| 28 | 0.85 |
| 32 | 0.90 |

In Examples 1 to 6 in which the solid sensitizer was added, a sufficiently high image density was obtained as compared with Comparative Example 1 in which the solid sensitizer was not added and also the fog (value at applied energy=0) was small. Furthermore, since varying the applied energy resulted in a stepped change in permeability of the microcapsule, and gradation was visually excellent.

While the invention has been described in detail and with reference to specific embodiments thereof, it will be apparent to one skilled in the art that various changes and modifications can be made therein without departing from the spirit and scope thereof.

What is claimed is:

1. A heat transfer recording medium comprising a support having thereon a transfer layer comprising (a) microcapsules containing an oil-soluble dye dissolved in an organic solvent and (b) a sensitizer being solid at ordinary temperature and capable of melting on heating to swell the microcapsule wall and release said dye, wherein said heat transfer recording medium further comprises a subbing layer between said support and said transfer layer, said subbing layer being 0.1 to 0.5 μm thick.

2. The heat transfer recording medium as claimed in claim 1, wherein said dye is selected from the group consisting of copper phthalocyanine dyes, xanthene dyes, azo dyes and triphenyl dyes, and said organic solvent is selected from the group consisting of phosphoric acid esters, phthalic acid esters, carboxylic acid esters, carbonic acid esters, fatty acid amides, alkylated biphenyls, alkylated terphenyls, chlorinated paraffins, alkylated naphthalenes, and diarylethane.

3. The heat transfer recording medium as claimed in claim 1, wherein said microcapsules have walls comprising at least one polymer selected from the group consisting of a polyurethane, a polyurea, a polyamide, a polyester, a polycarbonate, a urea-formaldehyde resin, a melamine resin, polystyrene, a styrene-methacrylate copolymer, a styrene-acrylate copolymer, gelatin, polyvinylpyrrolidone and polyvinyl alcohol.

4. The heat transfer recording medium as claimed in claim 3, wherein said polymer is selected from the group consisting of a polyurethane, a polyurea, a polyamide, a polyester and a polycarbonate.

5. The heat transfer recording medium as claimed in claim 4, wherein said polymer is a polyurethane or a polyurea.

6. The heat transfer recording medium as claimed in claim 1, wherein said sensitizer is a plasticizer for said microcapsule wall polymer, said sensitizer having a melting point of from about 50° to 200° C.

7. The heat transfer recording medium as claimed in claim 6, wherein said sensitizer is selected from the group consisting of a hydroxy compound, a carbamic acid ester compound, an aromatic alkoxy compound, an organic sulfonamide compound, an aliphatic amide compound and an arylamide compound.

8. The heat transfer recording medium as claimed in claim 1, wherein said microcapsules and said sensitizer are contained in a transfer layer comprising from about 0.05 to 1 part by weight of said sensitizer per part by weight of said microcapsules.

9. The heat transfer recording medium as claimed in claim 8, wherein said sensitizer is in the form of particles having a diameter of from about 0.1 to 10 μm, and said microcapsules have an average diameter of from about 0.1 to 20 μm.

10. The heat transfer recording medium as claimd in claim 8, wherein said transfer layer is from about 1 to 10 μm thick.

11. The heat transfer recording medium as claimed in claim 8, wherein said transfer layer contains said sensitizer as a solid dispersed in a water-soluble polymer binder.

12. The heat transfer recording medium as claimed in claim 1, wherein said support is a polyester film sheet.

* * * * *